US008267289B2

(12) United States Patent
Irvin

(10) Patent No.: US 8,267,289 B2
(45) Date of Patent: Sep. 18, 2012

(54) WEARABLE WALLET

(76) Inventor: JillAnn Tremblay Irvin, Stoneham, MA (US)

( * ) Notice: Subject to any disclaimer, the term of this patent is extended or adjusted under 35 U.S.C. 154(b) by 988 days.

(21) Appl. No.: 12/284,984

(22) Filed: Sep. 26, 2008

(65) Prior Publication Data

US 2009/0090753 A1 Apr. 9, 2009

Related U.S. Application Data

(60) Provisional application No. 60/978,118, filed on Oct. 7, 2007.

(51) Int. Cl.
*A45F 3/14* (2006.01)
*A45F 3/00* (2006.01)

(52) U.S. Cl. ..... 224/218; 224/219; 224/222; 224/267; 150/131

(58) Field of Classification Search ..... 224/221, 224/218, 219, 222, 267, 220, 575, 578, 601, 224/677, 681, 250; 150/131, 110, 118, 108, 150/102, 101, 100; D3/243, 247, 250, 240, D3/241; 383/86, 26, 24
See application file for complete search history.

(56) References Cited

U.S. PATENT DOCUMENTS

| | | | | | |
|---|---|---|---|---|---|
| 509,341 | A | | 11/1893 | Ward | |
| 520,431 | A | | 5/1894 | Holzhauer | |
| 522,809 | A | | 7/1894 | Tompkins | |
| 744,151 | A | | 11/1903 | Amson | |
| 811,215 | A | * | 1/1906 | Goldsmith | 150/108 |
| 1,182,580 | A | | 5/1916 | Maxfield | |
| 1,438,145 | A | | 12/1922 | Swartz | |
| 1,562,408 | A | * | 11/1925 | Berkowitz | 150/103 |
| 1,735,655 | A | | 11/1929 | Pitkin | |
| 1,883,702 | A | | 10/1932 | Gomi | |
| D143,227 | S | * | 12/1945 | Kaufman | D3/246 |
| D161,362 | S | * | 12/1950 | Nessimoff | D3/243 |
| D161,980 | S | * | 2/1951 | Weinstein | D3/243 |
| 2,710,639 | A | | 6/1955 | Farls | |
| 3,354,925 | A | | 11/1967 | Doppelt | |
| 3,387,641 | A | * | 6/1968 | Osborne | 150/132 |
| 4,570,688 | A | * | 2/1986 | Williams | 150/134 |
| 5,215,237 | A | * | 6/1993 | Wu | 224/230 |
| 5,307,966 | A | * | 5/1994 | Inaba et al. | 224/578 |
| 5,924,136 | A | | 7/1999 | Ogean | |
| 6,112,961 | A | | 9/2000 | Phillips | |
| 6,182,169 | B1 | * | 1/2001 | Force et al. | 710/62 |
| 2002/0139823 | A1 | * | 10/2002 | Johnson | 224/250 |
| 2003/0057240 | A1 | | 3/2003 | Johnson | |
| 2004/0031830 | A1 | * | 2/2004 | Davis | 224/222 |

FOREIGN PATENT DOCUMENTS

| | | |
|---|---|---|
| GB | 9828 | 0/1906 |
| GB | 363104 | 12/1931 |

* cited by examiner

*Primary Examiner* — Nathan J Newhouse
*Assistant Examiner* — Matthew Theis
(74) *Attorney, Agent, or Firm* — Scott Lefton

(57) ABSTRACT

A wearable wallet has an elastic multi-part strap strung through two holes in the wallet, one hole in a cover flap over the wallet compartment opening and one hole in the bottom of the wallet back. The strap is composed of two conjoined loops forming an elongated "figure 8" where one loop is small and one loop is large. The small loop is just big enough to allow the large loop to be inserted through, causing the large loop to be divided into two parts. These two parts function as securing loops which can be variably proportioned and wrapped in a variety of useful ways, allowing the wallet to be easily reconfigured for wearing as a small purse dangling from a strap, as a wallet attached by elastic straps directly to an arm or hand or leg, or attached to a belt or some strap on clothing.

22 Claims, 9 Drawing Sheets

WEARABLE WALLET

I claim the benefit of the priority date of Provisional Patent Application No. 60/978,118 filed Oct. 7, 2007 entitled WRIST OR CLOTHING OR ANKLE WALLET.

STATEMENT REGARDING FEDERALLY SPONSORED RESEARCH OR DEVELOPMENT

N/A

BACKGROUND

The present invention relates generally to wallets worn attached to the body or clothing, and more specifically to a wallet including a reconfigurable elastic strap as the means for attachment.

The most common type of wallet has one or more compartments and is made to be carried in a pocket. If the wallet's owner is wearing clothing without pockets, this type of wallet becomes very impractical. There are also purses and bags which have one or more straps to be held in a hand or over an arm, but these limit the ability of the limb engaged with the purse or bag to perform other functions. When realized as a purse, this type of carrier also tends to be relatively large and heavy. There are also wallets or purses designed to be held solely on the hand, rather than on the arm or wrist. This style of wallet or purse is generally very specialized in form and of limited utility.

A variant on the standard wallet or purse is the "safety purse", which employs a closely fitting loop of a strap around the arm to prevent the possible dropping or loss of a wallet, purse or pocket book held in the hand. This specialized type of strap ends up limiting the utility of the wallet or purse, in addition to the fact that a hand must be dedicated to holding it.

Another type of wallet is the arm or leg wallet which is a holder for small items, generally formed to encircle a limb and secured with a closure, which may include elastic and may also include a discrete strap. This style of wallet is often used in connection with casual athletic or sports activities, and is limited in wearability to the limb attachment for which it was designed.

There are also purses, shoulder bags, backpacks and other article carriers with variable-length straps, where the variable-length capability is realized using folded or partially recessed lengths of strap. These generally require multiple fasteners or some recessed or semi-recessed additional elastic to control the strap length, movement and tension, and as such add complexity, weight and expense.

One example of a wallet with an adjustable strap is taught by U.S. Pat. No. 3,354,925 filed Nov. 27, 1964 entitled LADY'S PURSE which discloses a lady's purse that includes a handle strap ". . . which is adjustable so that the length thereof may be increased to accommodate a lady's hand which may be slipped thereinto, and which strap may otherwise be moved to a centered position for normal use." The '925 patent teaches a pair of straps each having an end loop enclosing the other strap and thus forming a sliding joint. The straps are also permanently attached to the wallet at the end of the strap opposite the end loop, and optionally by a fastener in the center of the two straps. While this design permits some flexibility on the hand holding position for the purse, it does not permit either secure attachment to a limb or article of clothing, or to be hung from the strap as a conventional purse.

Another example of a purse or wallet with a flexible strap is taught by British Patent No. GB 363,104 filed Nov. 6, 1930 entitled IMPROVEMENTS IN ATTACHING PURSES, CASES OR HOLDERS TO THE PERSON discloses a "purse, case or holder" that may be secured to the hand with a continuous loop of non-elastic cord threaded through multiple pairs of eyelets in a manner that allows variable means for securing. This loop and eyelet arrangement does allow a variety of holding and securing methods to be used, but the lack of elasticity requires the loop to be twisted multiple times to take up slack if the purse is to be held close to the limb. Further, a shaped cutout in the purse and a large number of eyelets are required for this purse to work properly.

Still another example of a wallet with a flexible strap is taught by U.S. Pat. No. 1,735,655 filed Jul. 26, 1928 entitled FINGER AND BACK STRAP FOR HAND BAGS, which discloses a hand bag with a strap capable of being reconfigured for multiple styles of holding around a limb by being divided into two loops. This strap is not elastic and rather than passing through any interior portion of the bag, or any grommets or other openings in the bag itself, passes through a "loop member" attached to the outside of the bag. This strap works essentially in two shapes only, a conventional strap-type handle and a hand-strap that permits the strap to hold the bag to the palm of the hand. More flexibility in the use of this strap is prevented by the non-elastic "preferably leather" nature of the strap, and by the width of the strap.

Yet another example of a wallet with a flexible strap is taught by U.S. Pat. No. 1,438,145 filed Jul. 18, 1921 entitled COMBINED CHANGE PURSE AND MEMORANDUM BOOK which discloses a combined change purse and memorandum book which uses an elastic strap folded double and a stitched or otherwise bonded middle portion to create a loop suitable for either suspending the wallet from a limb or article of clothing or to secure the wallet to a limb when the elastic is used as a surrounding band. The elastic is permanently attached to the wallet at the end opposite the loop and thus lacks any ability to vary the loop proportions for optimizing different kinds of attachment.

A standard type of wrist or ankle worn wallet or purse is taught by U.S. Pat. No. 6,227,424 filed Feb. 9, 2000 entitled SECURITY PURSE, which attaches a small purse to a wrist with a buckled strap. While this purse could be attached to an ankle or conceivably to an article of clothing with the buckled strap, it still is essentially a very limiting mode of attachment.

Another example of a standard type of wrist or ankle worn wallet is taught by Patent Application Publication No. US2004/0031830 filed Aug. 16, 2002 entitled Pocket Band wherein a small pocket-type purse is held onto a limb with an adjustable elastic strap. While this style of strap is well suited for attaching an article to a limb, it is not conveniently used for any other method of carrying the purse.

A significant improvement over the existing art is a wallet with an elastic multi-part strap allowing the wallet to be worn in multiple ways, including hung from the arm, attached securely to an arm or leg, attached to the back or palm of a hand, and attached to a belt or an article of clothing.

SUMMARY

In accordance with the present invention, a wearable wallet with a multi-part strap is disclosed. A first loop of the strap is secured to the wallet at a first attachment point and a second loop of the strap is secured to the wallet at a second attachment point, where these attachment points are along an approximate centerline of the wallet. The first loop is threaded through the second loop, forming a first securing loop between the first attachment point and the second loop, and a second securing loop past the second loop. Preferably, the first loop and second loop are made from a single elastic strap forming an elongated "figure 8" where one loop is small and one loop is large.

This multi-part strap is preferably strung through two holes in the wallet, one hole in a cover flap over the wallet compartment opening and one hole in the bottom of the wallet back. The small loop protrudes from the cover flap hole and the main portion of the large loop protrudes from the wallet back hole. The small loop is just wide enough to allow the large loop to be inserted through, causing the protruding portion of the large loop to be divided into two parts. These two parts function as the securing loops which can be variably proportioned and formed into a variety of useful strap configurations. This allows the wallet to be easily reconfigured for wearing as a small purse dangling from a strap, or as a wallet attached by elastic straps directly to an arm, hand or leg, or to a belt or a strap on clothing.

BRIEF DESCRIPTION OF THE SEVERAL VIEWS OF THE DRAWINGS

A more complete understanding of the invention and its advantages will be apparent from the detailed description taken in conjunction with the accompanying drawings in which.

DETAILED DESCRIPTION

Figure 1:
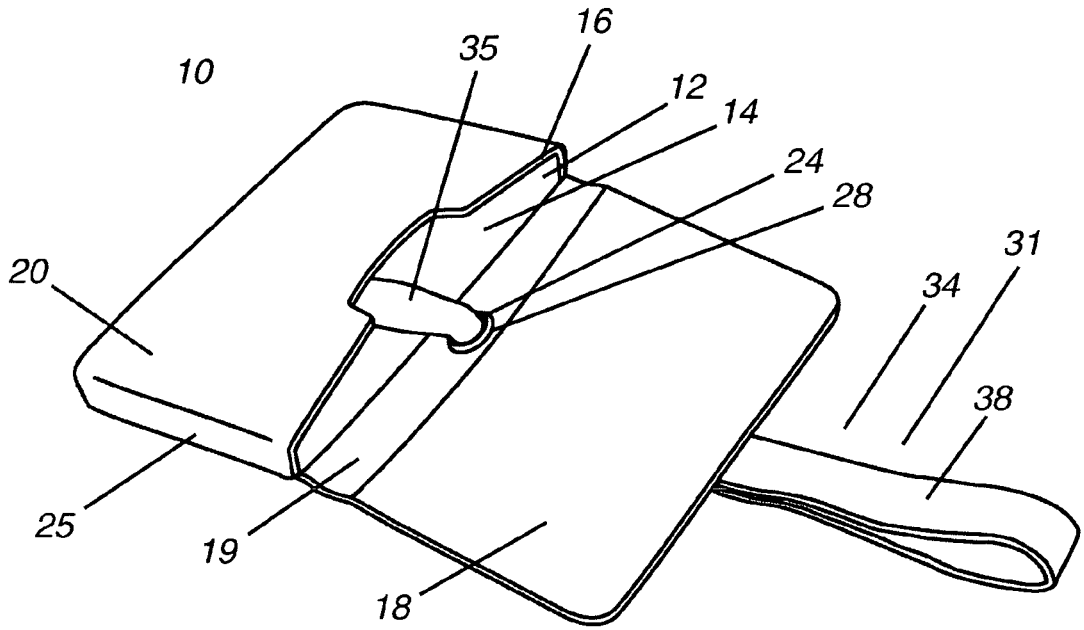
FIG. 1 is a perspective view of the front of the open wallet.
Figure 2:
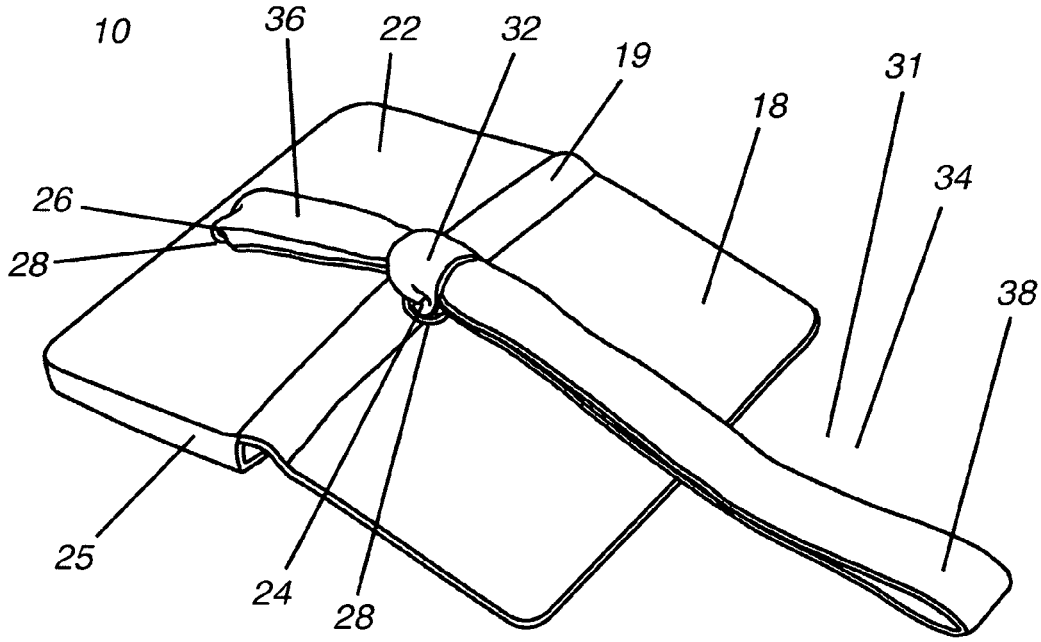
FIG. 2 is a perspective view of the back of the open wallet.
Figure 3:
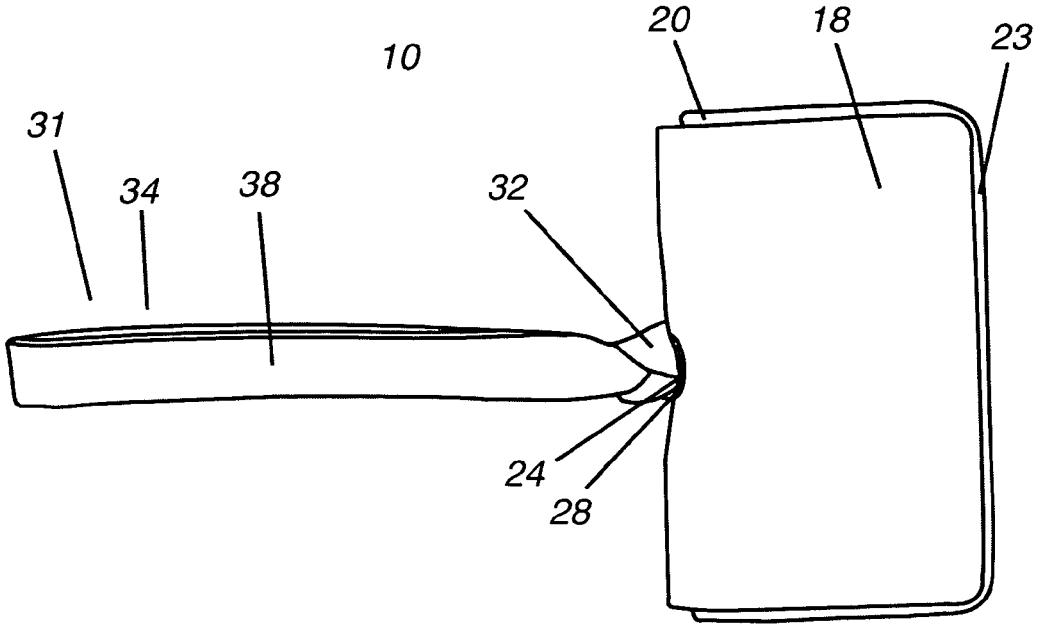
FIG. 3 is a plan view of the front of the closed wallet.
Figure 4:
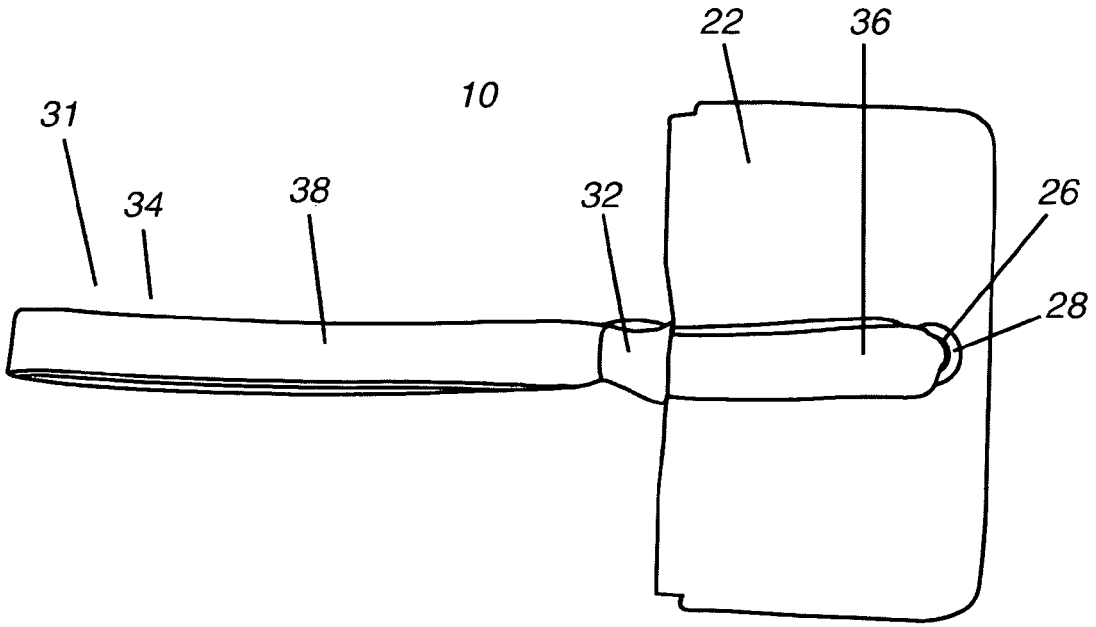
FIG. 4 is a plan view of the back of the closed wallet.

As shown in FIGS. 1-4, the wallet 10 has a first or front surface 20 and a second or back surface 22 which along a top edge 16 border an opening 14 into a compartment 12. The front surface 20 and back surface 22 may also be joined by a bottom surface 23 and side surfaces 25. Attached to the back surface 22 is a cover flap 18 which includes a flexible portion 19, allowing the cover flap 18 to cover the opening 14. In the center of the flexible portion 19 of the cover flap 18 is a first hole 24. In the bottom center of the back surface 22 is a second hole 26. In the preferred embodiment, the holes are positioned along an approximate centerline of the wallet 10. A multi-part strap 31 is threaded through the holes. By having the strap 31 as a separate element from the structure of the wallet body, there is the option of replacing a damaged or worn strap, or of having different sizes and lengths of straps for different sizes of users, i.e. for children and adults, while having the same size of wallet body. In the preferred embodiment the holes are reinforced with grommets 28.

Figure 5:
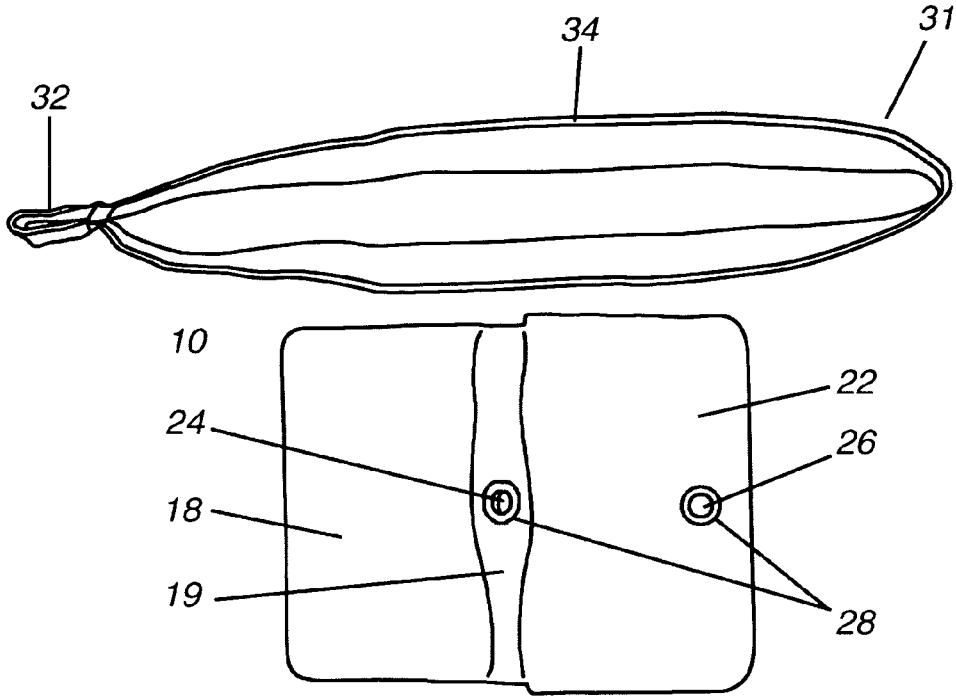
FIG. 5 is a plan view of the separate multi-part strap and back of the open wallet.
Figure 6:
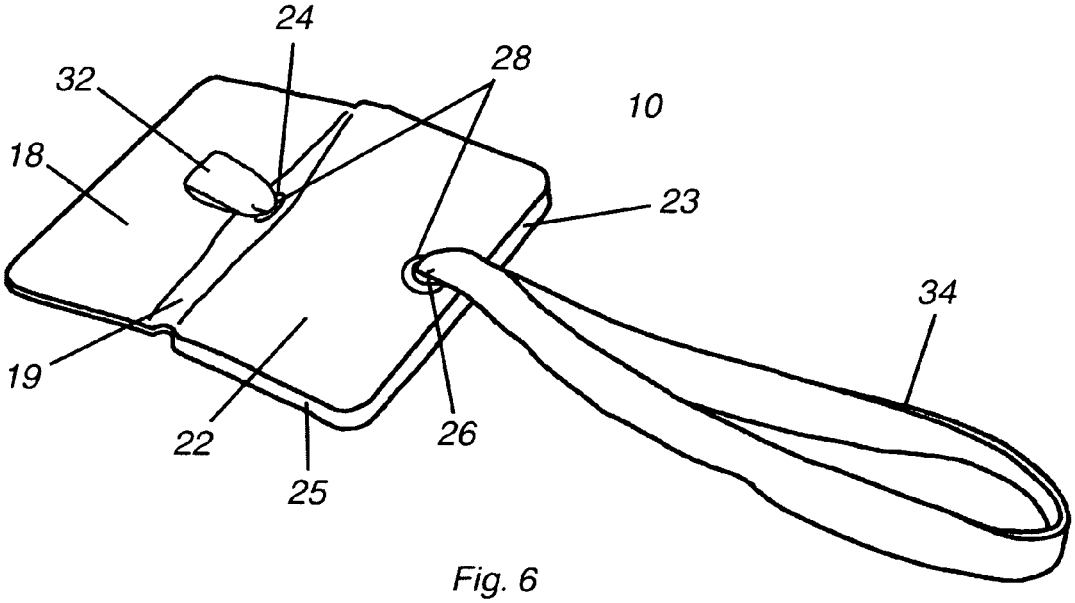
FIG. 6 is a perspective view of the strap inserted into the back of the open wallet.

FIG. 5 shows the multi-part strap 31 composed of a conjoined small loop 32 and large loop 34. The strap 31 is preferably made of elastic fabric which is preferably no more than ¾" wide. The strap 31 is threaded through the first hole 24 and second hole 26, passing inside the body of the wallet 10. In the preferred embodiment the internal portion 35 of the strap 31 passes directly through the compartment 12. The small loop 32 protrudes from the first hole 24 and the majority of the large loop 34 protrudes from the second hole 26. This configuration is shown in FIG. 6.

Figure 7:
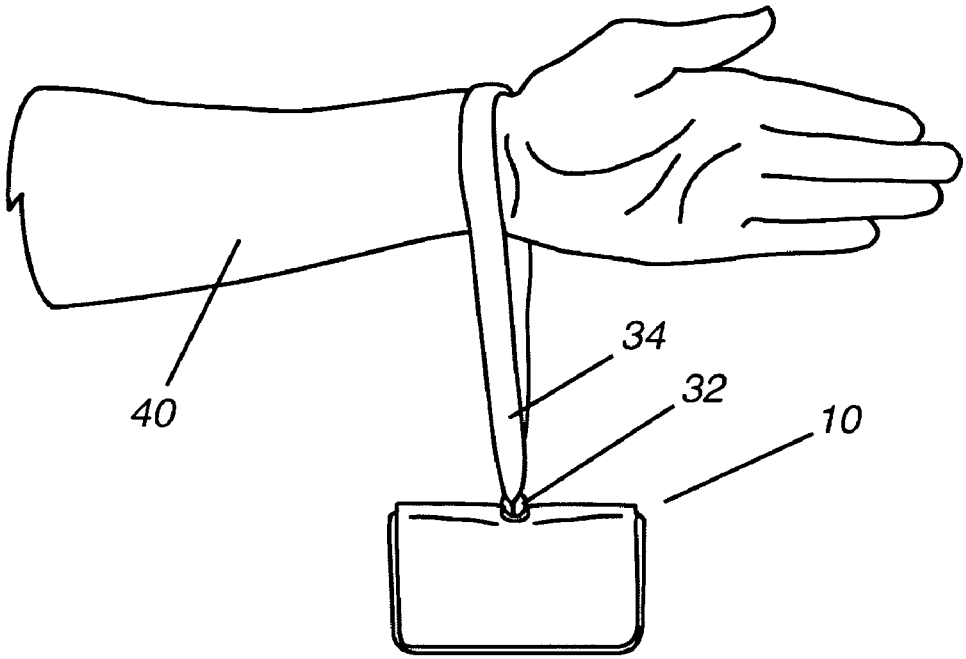
FIG. 7 is a side view of the wallet suspended from an arm.
Figure 8:
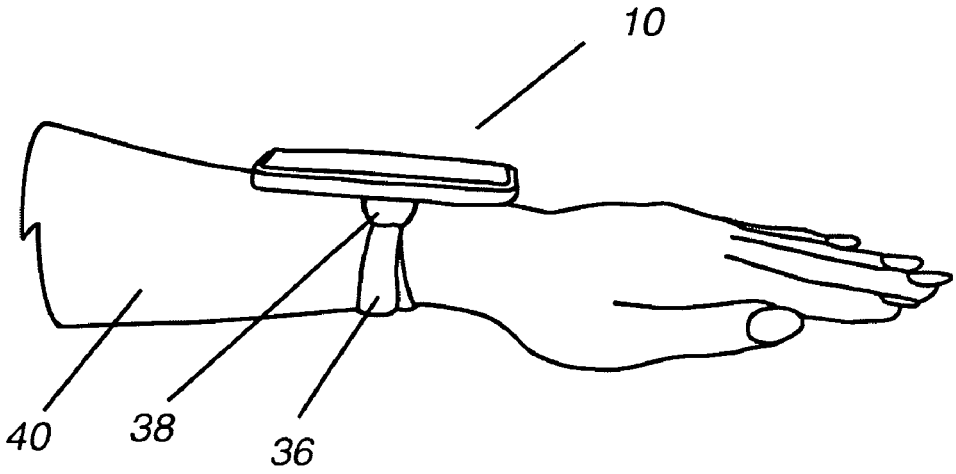
FIG. 8 is a side view of the wallet secured to an arm in a two-strap mode.
Figure 9:
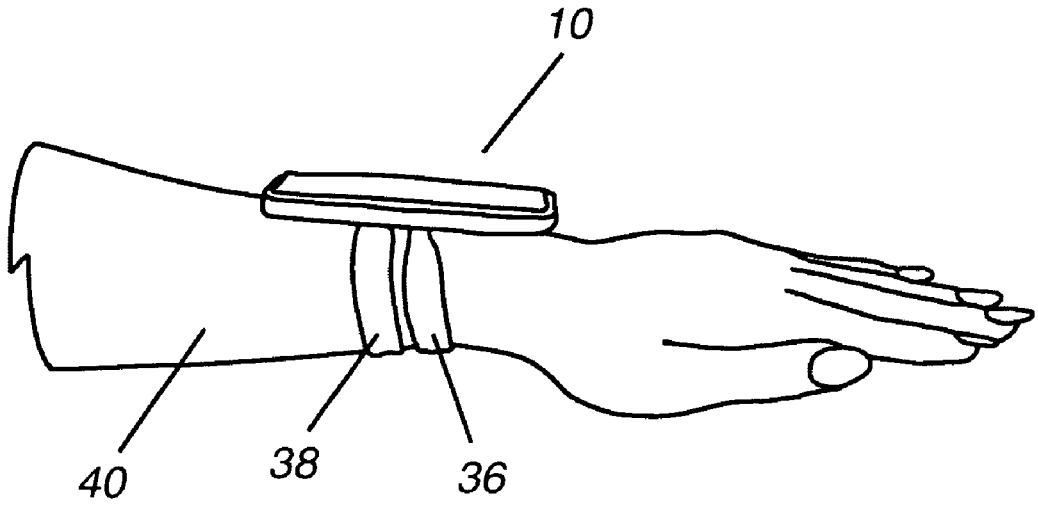
FIG. 9 is a side view of the wallet secured to an arm in an alternate two-strap mode.
Figure 10:
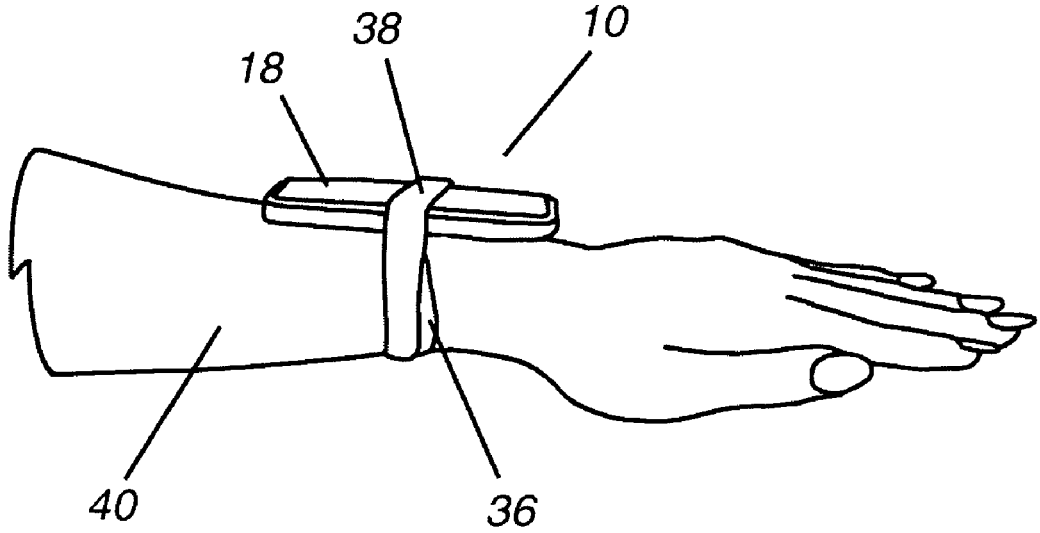
FIG. 10 is a side view of the wallet secured to an arm in another alternate two-strap mode.
Figure 11:
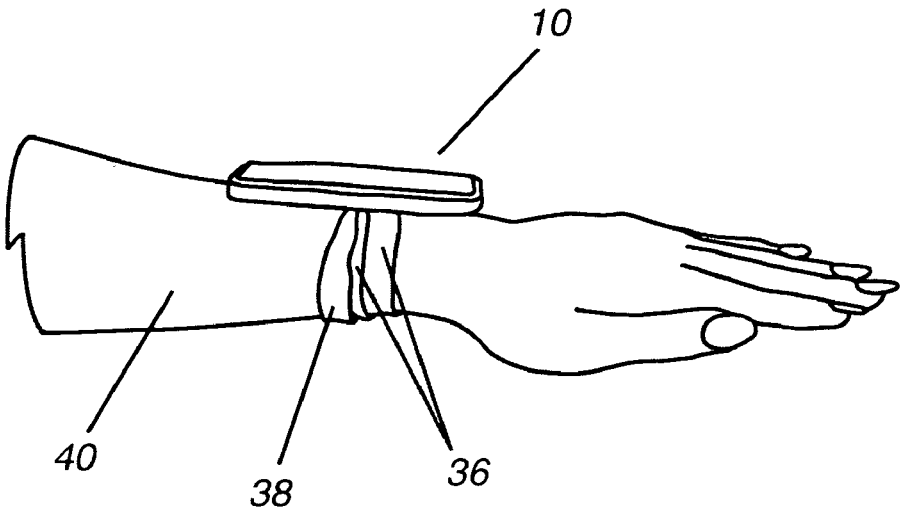
FIG. 11 is a side view of the wallet secured to an arm in a three-strap mode.

With the large loop 34 inserted through the small loop 32, the large loop 34 is divided into a first securing loop 36 located between the second hole 26 and the small loop 32, and a second securing loop 38 located beyond the small loop 32. The wallet 10 may be worn as a purse suspended from an arm 40 as shown in FIG. 7. FIG. 8 shows the wallet worn in direct contact with the arm 40 by inserting the arm through either one or both portions of the first securing loop 36 and then wrapping the second securing loop 38 over the body of the wallet 10 so that the second securing loop 38 tightens the first securing loop 36 around the arm 40. The wallet 10 may be also worn in direct contact with the arm 40 as shown in FIG. 9 by inserting the arm 40 through both the first securing loop 36 and the second securing loop 38. Alternatively, as shown in FIG. 10, the second securing loop 38 can be wrapped over the closure flap 18 to further secure the closure of the wallet. Another alternate mode of configuring the strap 31 for wearing the wallet 10 is shown in FIG. 11 wherein both halves of the first securing loop 36 are placed around the arm 40 in addition to the arm being inserted through the second securing loop 38. This uses three sections of the strap 31 to hold the wallet 10 against the arm 40.

Figure 12:
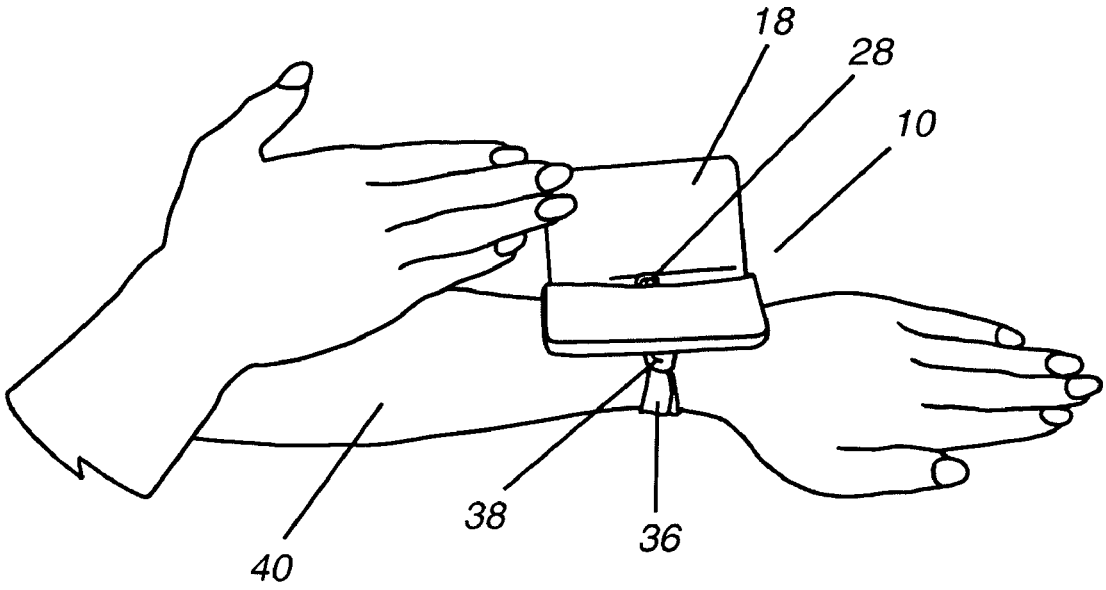
FIG. 12 is a perspective view of the wallet being opened while secured to a wrist.
Figure 13:
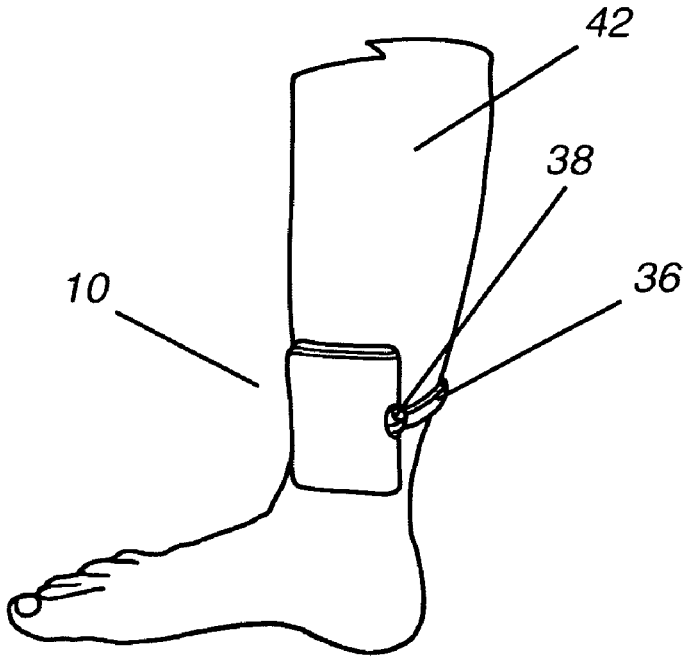
FIG. 13 is a perspective view of the wallet secured to a leg.
Figure 14:
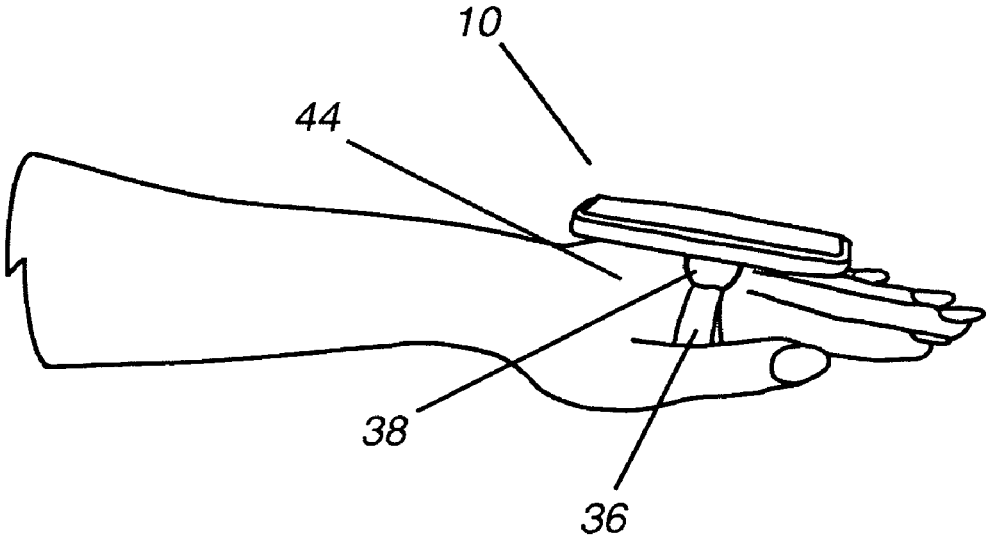
FIG. 14 is a perspective view of the wallet secured to a hand.
Figure 15:
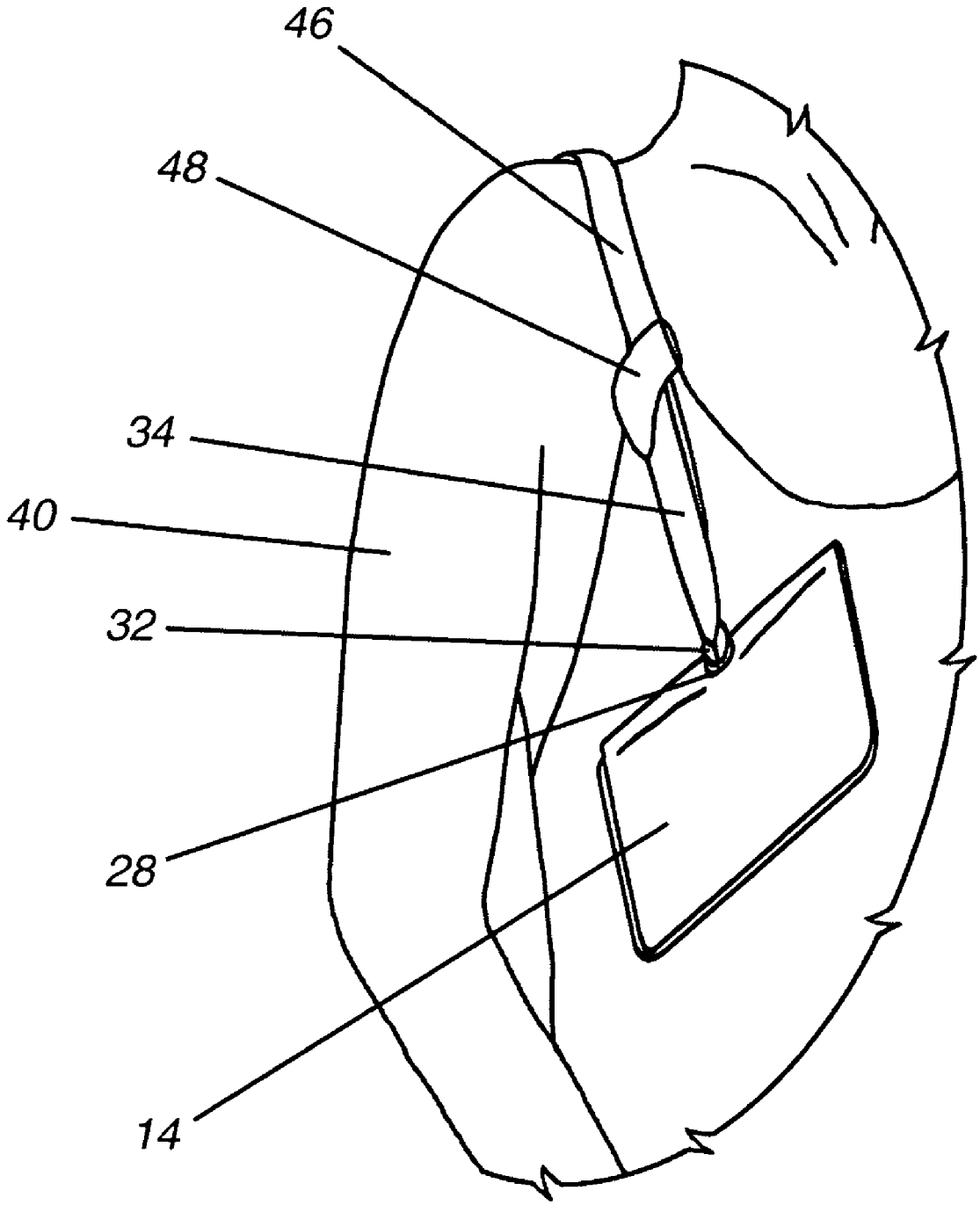
FIG. 15 is a perspective view of the wallet secured to a clothing strap.

The wearing modes shown in FIGS. 8, 9 and 11 allow the wallet 10 to be easily opened while being worn, as shown in FIG. 12. The wearing modes of FIGS. 8-11 also allow the wallet to be worn on a leg 42 as shown in FIG. 13. In all the wearing modes of FIGS. 8-13 the back surface 22 of the wallet 10 directly functions as part of the mechanism of attachment to the limb. Additionally, the wallet may be secured to the back of a hand as shown in FIG. 14 by any of the wearing modes shown in FIGS. 8-13, or secured in the palm by the same wearing modes. The wallet 10 may also be secured to a belt or to a clothing strap 46 as shown in FIG. 15, as well as by the wearing modes shown in FIGS. 8-13. For this method of securing, the large loop 34 may have a knot 48 tied to aid in retention.

While the wallet 10 may be of a variety of sizes and shapes, the preferred embodiment has the first hole 24 and second hole 26 spaced no less than approximately 1 inch apart and no more than approximately 4 inches apart for optimal securing of the wallet 10 to an arm 40 or leg 42. In functional terms, these holes can be viewed as preferred attachment points for the small loop 32 and the large loop 34. Additionally, the preferred embodiment of the wallet 10 has a closure such as a magnetic catch, zipper, button, Velcro or similar hook-and-loop closures, or a snap fitting incorporated into the cover flap 18 and front surface 20. If there is no cover flap, the closure is simply used to secure the compartment 12.

An alternate embodiment of the wallet 10 has the first hole 24 located in the top center of the back surface 22.

Another alternate embodiment of the wallet 10 has the first hole 24 located in the top center of the back surface 22 and the second hole 26 located in the center of the bottom surface 23.

Yet another alternate embodiment of the wallet 10 has the large loop 34 protruding from the first hole 24 and the small loop 32 protruding from the second hole 26. This configuration allows the large loop 34 to be used directly as an arm strap, and still allows all of the other wearing modes.

Further alternate embodiments of the wearable wallet can be realized as long as the holes for the strap are preferably spaced between approximately 1 inch and approximately 4 inches apart, and the main axis of the strap is oriented along an approximate centerline of the wallet. If some combination of the loops is secured by attachment points other than holes this spacing criteria will also apply, and will continue to apply even if one or more loops are secured by multiple attachment points. In the case of multiple attachment points for a loop, whether the attachment points are holes or not, the approximate center between a loop's multiple attachment points is where the centerline measurement is taken from. This centerline may be other than horizontal or vertical and may even be diagonal. Additionally, including if the wallet is of irregular shape, the centerline may simply result from an arbitrary visual bisecting of the wallet. The wallet may have more than one compartment, and may have a non-rectangular shape too, as long as the constraints of strap orientation are met.

Still another alternate embodiment of the wearable wallet can be realized with a divided strap wherein at least a portion of the strap is in a V shape, or with closely spaced multiple sets of straps.

Yet another further alternate embodiment of the wearable wallet has at least portions of the strap being up to approximately 4" wide for purposes including holding the wallet to the wearer with more of a band of contact than just narrow straps.

Figure 16:
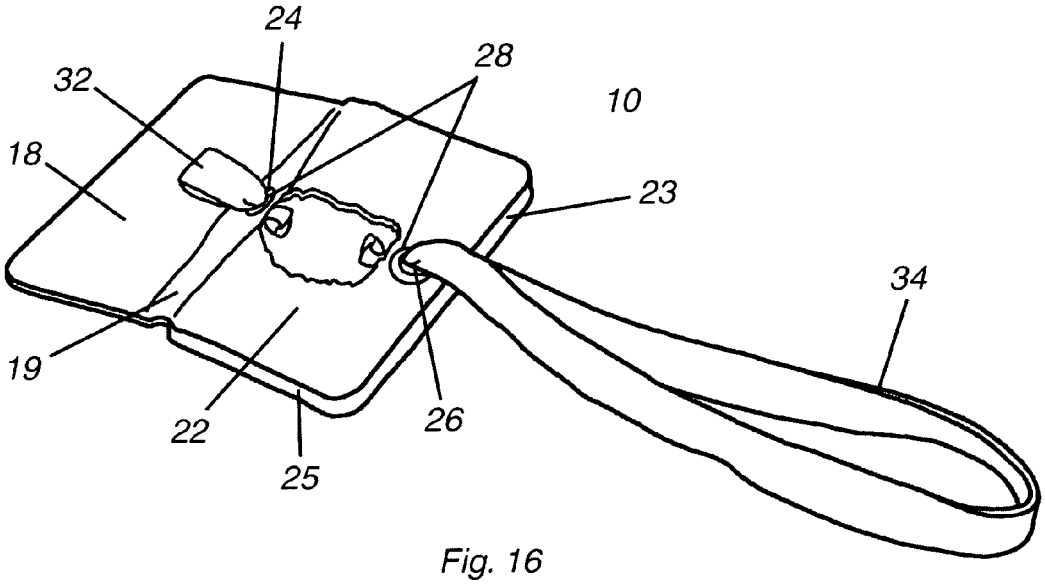
FIG. 16 is a perspective view of an embodiment of the wallet with a strap having two separate loops of material.

An additional alternate embodiment of the wearable wallet can be realized with the large loop 34 and the small loop 32 attached separately or together to the body of the wallet instead of protruding through holes or grommets. In this embodiment the loops will still interact in the same fashion and have the same body attachment modes, but may be two separate loops of material as shown through the surface of the wallet in FIG. 16, rather than being composed of one piece of material. In any embodiment of the wearable wallet one or more loops may be composed of flexible materials or combinations of flexible materials including but not limited to fabric, elastic fabric, plastic, rubber, leather, and synthetic leather. The small loop may be composed of a rigid or semi-rigid material and still provide proper function. In any embodiment of the wearable wallet more than two loops may be employed too, allowing configurations of straps with multiple large loops or small loops or both.

Having described herein illustrative embodiments of the present invention, persons of ordinary skill in the art will appreciate various other features and advantages of the invention apart from those specifically described above. It should therefore be understood that the foregoing is only illustrative of the principles of the invention, and that various modifications and additions can be made by those skilled in the art without departing from the spirit and scope of the invention. Accordingly, the appended claims shall not be limited by the particular features that have been shown and described, but shall be construed also to cover any obvious modifications and equivalents thereof.

What is claimed is:

1. A wearable wallet comprising:

a wallet having at least one compartment;

a first loop threaded through a first aperture in said wallet, a second loop threaded through a second aperture in said wallet, said first and second apertures being located along an approximate centerline of said wallet;

said centerline selected from the group consisting of vertical centerlines and horizontal centerlines;

said first aperture and said second aperture functioning respectively as a first attachment point and a second attachment point;

said second loop threaded through said first loop, thereby forming a first securing loop between said first attachment point and said second attachment point;

a portion of said first loop further forming a second securing loop beyond said second attachment point; and, said first securing loop and said second securing loop being variably configurable in relative size and orientation to provide a plurality of means for securing said wallet to a wearer.

2. A wearable wallet as described in claim 1 wherein said first loop and said second loop comprise a single strap of elastic material.

3. A wearable wallet as described in claim 1 wherein said first loop and said second loop are formed as a conjoined small loop and large loop, said small loop proportioned to allow threading therethrough by said large loop.

4. A wearable wallet as described in claim 1 wherein said first loop has an opening approximately ½ inch in diameter and said second loop is between approximately 4 inches and approximately 9 inches in diameter.

5. A wearable wallet as described in claim 1 wherein said first securing loop has two bands of material, which in combination with the single band of said second securing loop allows said wallet to be secured to a wearer with one, two or three bands of material.

6. A wearable wallet as described in claim 1 wherein at least one of said first loop and said second loop are composed of material from the group including fabric, elastic fabric, plastic, rubber, leather, and synthetic leather.

7. A wearable wallet as described in claim 1 wherein at least a portion of said first loop and said second loop are composed of elastic material no more than approximately 4 inches wide.

8. A wearable wallet as described in claim 1 further comprising a closure for releasably securing said compartment.

9. A wearable wallet as described in claim 8 further comprising:

a cover flap forming at least a portion of said closure;

a first surface and a second surface, said compartment being contained between said first and second surfaces;

said cover flap being attached to said second surface;

said first aperture located in said cover flap; and, said second aperture located in said second surface.

10. A wearable wallet as described in claim 1 wherein the distance between said first attachment point and said second attachment point is in the range of approximately 1 inch and approximately 4 inches.

11. A wearable wallet as described in claim 1 wherein said first and second apertures are reinforced with rigid edge reinforcements such as grommets.

12. A wearable wallet comprising:

a wallet having at least one compartment with an opening along the top edge of said wallet and a cover flap capable of folding over and covering said opening;

said wallet having a first surface and a second surface, said compartment being contained between said first and second surfaces;

said cover flap being attached to said second surface;

a first aperture located in said cover flap approximately over the center of said opening;

a second aperture located in said second surface and in proximity to the center of the bottom edge of said second surface;

said first aperture and said second aperture being located along an approximate vertical centerline of said wallet;

a strap formed as a conjoined small loop and large loop, said small loop proportioned to allow threading through by said large loop;

said small loop threaded through said first aperture to protrude out of said wallet;

said large loop threaded through said second aperture to protrude out of said wallet and the protruding portion of said large loop threaded through said small loop, thereby forming a first securing loop between said small loop and said second hole, and a second securing loop beyond said small loop, and, said first securing loop and said second securing loop being variably configurable in relative size and orientation to provide a plurality of means for securing said wallet to the wearer.

13. A wearable wallet as described in claim 12, wherein said second surface is used in combination with said first and second securing loops to secure said wallet to the wearer.

14. A wearable wallet as described in claim 12 wherein said small loop has an opening approximately ½ inch in diameter and the portion of said large loop protruding from said second hole is between approximately 4 inches and approximately 9 inches in diameter.

15. A wearable wallet as described in claim 12, further comprising a closure for releasably securing said cover flap to said first surface.

16. A wearable wallet as described in claim 12 wherein:

a mechanical closure from the group including zippers, hook and loop fasteners, snaps, buttons, magnets, and springs is used instead of a cover flap to secure said opening; and, said first aperture is located in proximity to the top edge of said second surface.

17. A wearable wallet as described in claim 12 wherein said first aperture is located in said second surface and in proximity to the top edge of said second surface.

18. A wearable wallet as described in claim 12, further comprising a bottom surface located between said first and second surfaces and positioned opposite said closure flap;

wherein said first aperture is located in said second surface and in proximity to the center of said closure flap; and, said second aperture is located approximately in the center of said bottom surface.

19. A wearable wallet as described in claim 1 wherein said small loop and said large loop are physically separate and each affixed to said wallet.

20. A wearable wallet as described in claim 12 wherein at least one of said small loop and said large loop are composed of material from the group including fabric, elastic fabric, plastic, rubber, leather, and synthetic leather.

21. A wearable wallet comprising:

a wallet having at least one compartment with an opening along a top edge of said wallet and a cover flap capable of folding over and covering said opening;

said wallet having a first surface and a second surface, said compartment being contained between said first and second surfaces;

said cover flap being attached to said second surface and having a means for closure between said cover flap and said first surface;

a first aperture located in said cover flap approximately over the center of said opening;

a second aperture located in said second surface and in proximity to the center of the bottom edge of said second surface;

said first and second apertures being located along an approximate vertical centerline of said wallet;

said first and second apertures being reinforced with grommets;

a fabric elastic strap formed as a conjoined small loop and large loop, said small loop proportioned to allow threading through by said large loop;

said small loop threaded through said first aperture to protrude out of said wallet; and, said large loop threaded through said second aperture to protrude out of said wallet and threaded through said small loop, thereby forming a first securing loop between said small loop and said second hole and a second securing loop beyond said small loop, said first securing loop and said second securing loop being variably configurable in relative size and orientation to provide a plurality of means for securing said wallet to a wearer.

22. A wearable wallet as described in claim 3 further comprising:

a closure for releasably securing said compartment;

a cover flap forming at least a portion of said closure;

a first surface and a second surface, said compartment being contained between said first and second surfaces;

said cover flap being attached to said second surface;

said first aperture located in said cover flap;

said second aperture located in said second surface; and, said small loop and said large loop being respectively threaded through said first and second apertures and protruding from said wallet.

* * * * *